166-274 SR
5/7/85 XR 4,515,215

United States Patent [19]
Hermes et al.

[11] Patent Number: 4,515,215
[45] Date of Patent: May 7, 1985

[54] STEAM INJECTION METHOD WITH CONSTANT RATE OF HEAT

[75] Inventors: Chester E. Hermes; Wann-Sheng Huang, both of Houston, Tex.

[73] Assignee: Texaco Inc., White Plains, N.Y.

[21] Appl. No.: 581,922

[22] Filed: Feb. 21, 1984

[51] Int. Cl.[3] ..... E21B 43/24
[52] U.S. Cl. ..... 166/272; 166/274
[58] Field of Search ..... 166/272, 274

[56] References Cited

U.S. PATENT DOCUMENTS

| | | | |
|---|---|---|---|
| 3,042,114 | 7/1962 | Willman | 166/272 |
| 3,353,598 | 11/1967 | Smith | 166/272 |
| 3,360,045 | 12/1967 | Santourian | 166/272 |
| 3,483,924 | 12/1969 | Blevins et al. | 166/272 |
| 3,572,437 | 3/1971 | Marberry | 166/272 |
| 4,060,129 | 11/1977 | Gomaa et al. | 166/252 |
| 4,093,027 | 6/1978 | Gomaa | 166/272 |

*Primary Examiner*—Stephen J. Novosad
*Assistant Examiner*—Bruce M. Kisliuk
*Attorney, Agent, or Firm*—Jack H. Park; Kenneth R. Priem; Harold J. Delhommer

[57] ABSTRACT

A method is disclosed for recovering hydrocarbons from underground formations by a series of sequenced steps, involving (1) injecting steam of a relatively high quality into the formation and (2) about the time of steam breakthrough, reducing the quality of the steam being injected to a quality between about 25% and about 50% while simultaneously increasing the rate of steam injection so as to maintain a constant rate of heat injection into the formation. Optionally, hot water having a temperature between about 120° and 180° F. may be injected following the injection of about 0.5 pore volumes to about 2.5 pore volumes of reduced quality steam.

8 Claims, 6 Drawing Figures

STEAM INJECTION METHOD WITH CONSTANT RATE OF HEAT

BACKGROUND OF THE INVENTION

The invention pertains to a method for recovering increased quantities of hydrocarbons by initially injecting steam of a high quality and then reducing the quality of the steam being injected while increasing the rate of steam injection to maintain a constant input of heat into the formation.

Numerous thermal recovery techniques have been suggested and employed to increase the recovery of hydrocarbons from underground formations. Steam flooding and water flooding have proven to be the most successful of these oil recovery techniques yet employed commercially. But after a certain percentage of oil is produced, steam flooding can be a very expensive proposition, consuming more oil for the generation of steam than is incrementally produced from the pattern. Thus, one should always focus on net oil recovery. Net oil recovery is defined as the cumulative oil produced less the cumulative oil required as fuel to generate the necessary steam.

Several methods have been developed to reduce the cost of steam flooding but yet obtain similar hydrocarbon recovery efficiencies. These methods generally involve reducing the quality of steam injected into the formation. U.S. Pat. No. 4,093,027 discloses the injection of steam having a quality between 35% and 45%. U.S. Pat. No. 4,060,129 discloses the initial injection of high quality steam followed by the injection of low quality steam or water until the cumulative value of steam quality of all of the injected fluid is reduced to a value between 35% and 45% and then continuing to inject steam having a quality between 35% and 45%. A second technique is disclosed in U.S. Pat. No. 3,360,045 wherein steam injection is followed by hot water optionally containing a polymer to increase viscosity.

Another steam injection method is disclosed in copending U.S. patent application Ser. No. 463,215, filed Feb. 2, 1983, on a steam and water injection method. This patent application pertains to a sequenced method of injecting 0.1 to 0.6 pore volumes of high quality steam, then steam of a decreasing quality down to 0% quality, followed by water at an ambient temperature. A related U.S. patent application Ser. No. 463,203, filed Feb. 2, 1983, discloses a sequenced method of injecting high quality steam, followed by steam of a decreasing quality down to 0%, followed by water and finally, in situ combustion.

SUMMARY OF THE INVENTION

A method is disclosed for recovering hydrocarbons from underground formations by a series of sequenced steps. The first step involves injecting steam of a relatively high quality into the formation through one or more injection wells. The injection of high quality steam is continued until steam breakthrough at one or more production wells is imminent. About the time of steam breakthrough, the quality of the steam being injected is reduced to a quality between about 25% and about 50% while simultaneously increasing the rate of steam injection so as to maintain a constant rate of heat injection into the formation. Optionally, the injection of hot water having a temperature between about 120° and 180° F. may follow the injection of about 0.5 pore volumes to about 2.5 pore volumes of reduced quality steam. Hydrocarbons and other fluids are recovered at one or more production wells throughout the injection sequence.

DETAILED DESCRIPTION

Figure 1:
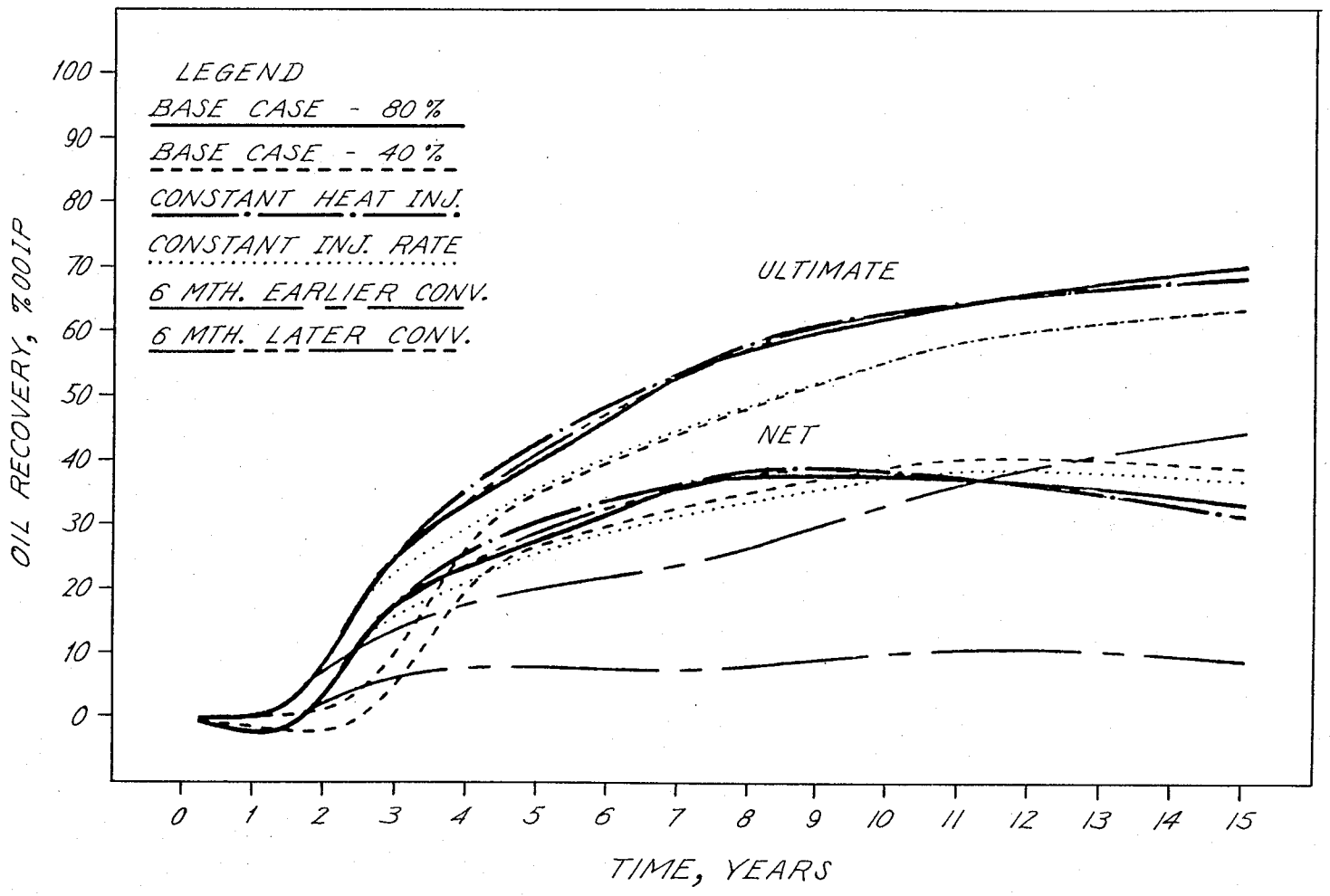
FIG. 1 is a graph comparing the ultimate recovery and net recovery of the invention method with various prior art methods and different conversion times.

The present invention provides a method for achieving oil recoveries and residual oil saturations similar to that of a full scale steam flood at less cost and at an earlier time than a normal steam flood and competing prior art methods.

In a steam flood, high quality steam is initially injected to establish an efficient steam front to sweep the formation. The mechanism of steam distillation causes significant amounts of light crude components to be separated from the bulk of the oil. These steam distilled components form a condensate bank concentrated immediately in advance of the steam zone. The bank is composed mostly of light end hydrocarbons and builds itself into an in situ generated miscible solvent bank which may occupy as much as about 5% to about 8% of pore volume. A steam distilled condensate bank of this type may approach 100% displacement efficiency.

However, because of density differences, the injected steam will tend to override the in-place reservoir fluids and breakthrough to a production well in the upper portion of the formation in which it was injected. Since the overriding steam vapor allows substantial quantities of heat to escape the reservoir without effectively contacting the remaining oil, the overall performance of a steam flood project decreases once steam breakthrough occurs. Thus, it is important to minimize this effect. Steam generator fuel requirements can also be considerable and since the crude production consumed as fuel to produce steam affects the profitability of the steam flood project, it is important that the injected heat be utilized effectively in the reservoir.

Consequently, the goal in the steam flooding operation is to utilize the injected steam in such a manner so as to obtain the highest net recovery of hydrocarbons at the earliest possible time. An earlier recovery of oil improves the rate of return of the project as well as freeing up steam generators for other flooding patterns.

The idea disclosed within requires the initial injection of high quality steam into a reservoir followed by conversion to the injection of relatively lower quality steam but at higher injection rates to maintain a constant rate of heat input into the reservoir. The initial slug of steam having a quality of about 70% to about 100% is injected in the amount of about 0.2 to about 1.0 pore volumes until steam breakthrough is imminent. At approximately the time of steam breakthrough at a production well, the quality of the steam being injected is reduced to a quality of about 25% to about 50% while the injection rate of the reduced quality steam is simultaneously increased to maintain a constant rate of heat input into the reservoir. The reduced quality steam is injected in the amount of about 0.5 pore volumes to about 2.5 pore volumes.

The timing of the conversion to reduced quality steam is important so as not to produce excessive pressures with the higher injection rates. The maintenance of a constant heat injection rate assures that the reservoir will not prematurely cool. By delivering more heat to the reservoir in the liquid phase, the steam override effect is reduced, the rate of heat production at production wells is lowered, more heat is retained in the reservoir and the cumulative heat-oil-ratio is lowered.

Once the relative maximum net recovery of oil is reached with the reduced quality steam, the injection of steam should be terminated as more crude will be consumed than will be incrementally produced. At this time, water may be optionally injected into the reservoir to further increase the ultimate and net recovery of oil in place. It is preferred that the injected water have a temperature of about 120° F. to about 180° F. The water injection steps should be continued as long as production economics are justified. Depending upon the reservoir, this may require from about 0.5 to about 2.5 pore volumes of water. For the entire process, it is desirable to inject from about 1.0 to about 4.0 pore volumes of total fluid into the reservoir.

The following examples will further illustrate the novel constant heat injection method of the present invention. These examples are given by way of illustration and not as limitations on the scope of the invention. Thus, it should be understood that the method may be varied to achieve similar results within the scope of the invention.

EXAMPLES

A computer simulation model was employed to generate examples. The Scientific Software-Intercomp Implicit Steam Flood Model used was a 3-phase, 3-dimensional numerical reservoir simulator developed for the design and analysis of thermally enhanced oil recovery operations. It is capable of simulating hot water flooding, steam flooding and cyclic steam stimulation processes.

The model simultaneously solves a set of mass and energy balance equations and constrained equations for each of the number of grid blocks representing a reservoir. The model uses Darcy's law to describe fluid flow, incorporating gravity, viscous and capillary forces. The heat transfer is handled by the mechanisms of convection and conduction within the reservoir and conductive heat loss to the cap and base rock. The model allows for any number and identity of components. Each component may partition among the water, oil and gas phases dictated by specified pressure and temperature dependent component K-values. The density and viscosity of each phase is a function of its composition, pressure and temperature. The features of temperature dependence of relative permeability, capillary pressure and rock heat capacity are incorporated in this model. The simulation studies were done on a 14° API gravity oil reservoir penetrated by an $11\frac{5}{8}$ acre, inverted 7-spot pattern. The basic reservoir data used in the simulation studies is given below in Table 1.

TABLE 1

BASIC RESERVOIR DATA

| | |
|---|---|
| Reservoir Type | Homogeneous |
| Initial Temperature, °F. | 100 |
| Initial Pressure, psia | 75 |
| Thickness, ft. | 120 |
| Horizontal Permeability, mD | 3000 |
| Vertical Permeability, mD | 900 |
| Porosity, fraction | 0.376 |
| Formation Thermal Conductivity, Btu/day-ft-°F. | 31 |
| Formation Heat Capacity, Btu/ft$^3$-°F. | 37 |
| Overburden and Underburden Thermal Conductivity, Btu/day-ft-°F. | 24 |
| Overburden and Underburden Heat Capacity, Btu/ft$^3$-°F. | 46 |
| Initial Oil Saturation, fraction | 0.60 |
| Initial Water Saturation, fraction | 0.40 |

Figure 2:
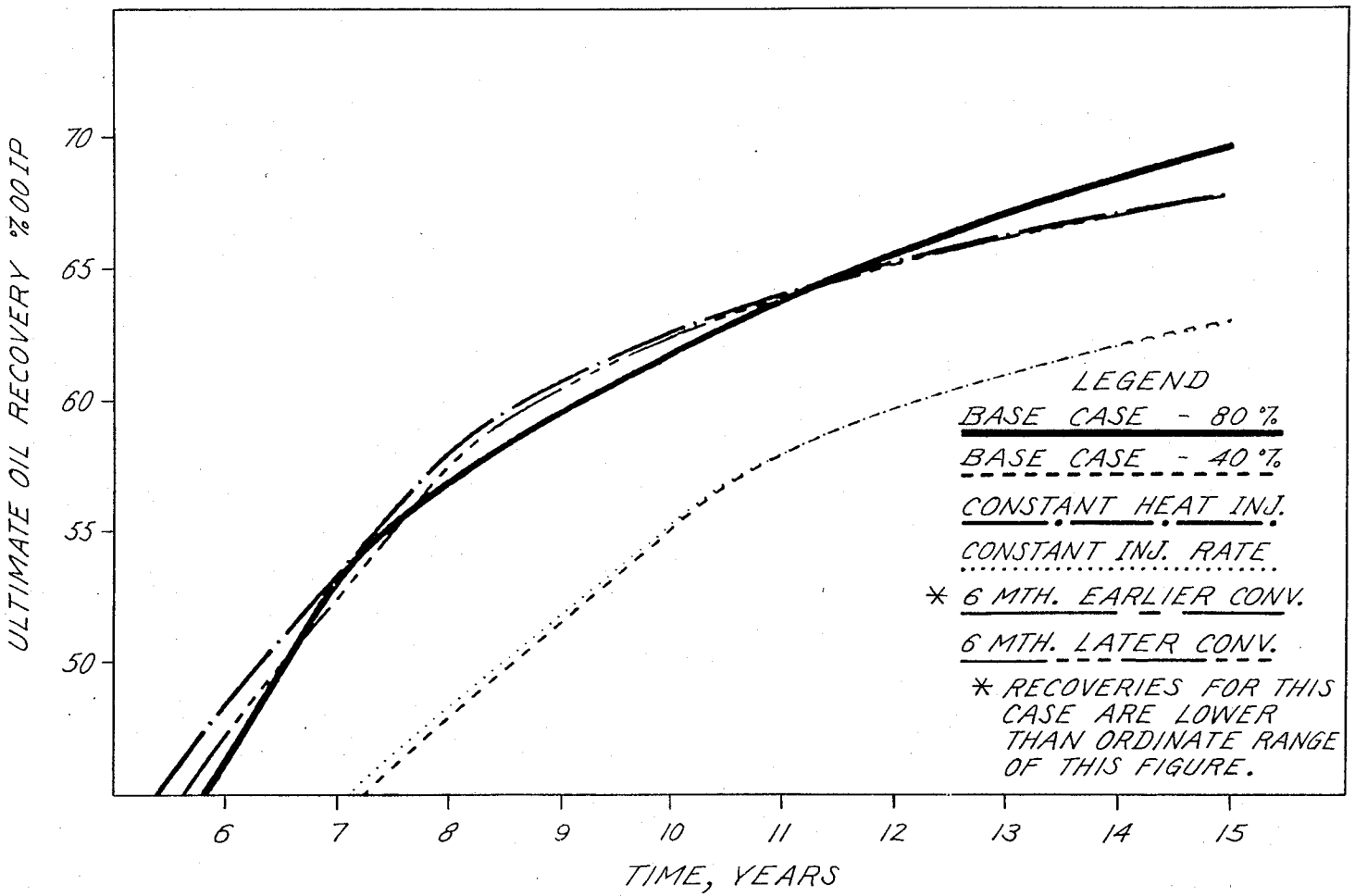
FIG. 2 is an expansion of a portion of FIG. 1 showing the ultimate recovery of various injection methods.
Figure 3:
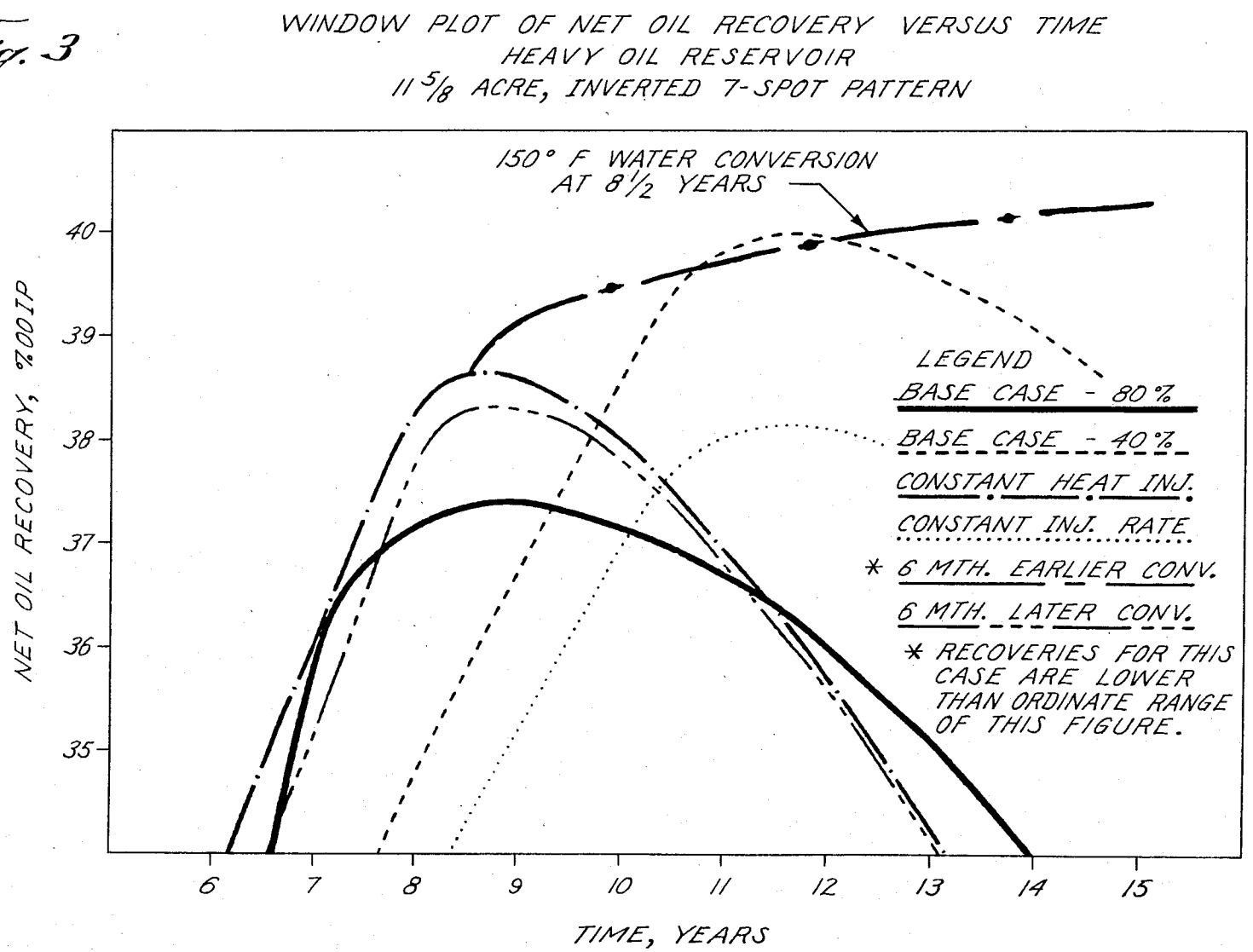
FIG. 3 is an expansion of a portion of FIG. 1 showing net oil recovery for the various steam injection methods.

FIGS. 1–3 graphically illustrate the ultimate and net oil recovery results of six different simulations including three runs based on the present invention. The 80% base example shows the ultimate and net recovery of a constant injection of 80% quality steam. The 40% base case shows the ultimate and net oil recovery of the constant injection of 40% quality steam such as disclosed in U.S. Pat. No. 4,093,027, previously cited. The constant heat injection case illustrates the recoveries when the present invention is practiced along the lines representing a six month earlier conversion and a six month later conversion. These last two conversion cases refer to simulated injection sequences where the conversion is made to reduced quality steam six months prior to steam breakthrough and six months after steam breakthrough. The constant injection rate case gives the results of a sequence wherein 80% quality steam is initially injected followed by conversion to 40% quality steam such as disclosed in U.S. Pat. No. 4,060,129, previously cited.

The figures graphically illustrate the substantial advantage to be gained from using the injection sequence of the present invention wherein high quality steam of about 80% is initially injected, followed by the conversion to steam of about 40% quality at about the time of steam breakthrough wherein the injection rate of the lower quality steam is increased to maintain a constant rate of heat input into the formation. The net recovery results as illustrated by FIG. 3 shows a substantial advantage to be achieved by the present invention in net oil recovery over the prior art methods which do not maintain a constant rate of heat injection into the formation after the conversion to lower quality steam. This includes the prior art methods of constantly injecting a lower quality 40% steam and a conversion from high quality 80% steam to lower quality 40% steam while maintaining a constant injection rate. Furthermore, FIG. 3 also illustrates that these greater recoveries are obtained approximately three years earlier than the prior art methods, about $8\frac{1}{2}$ years instead of 11 to 12 years.

The advantage of following the injection of lower quality steam at a constant heat injection rate with the injection of hot water at a temperature of about 150° F. is illustrated in FIG. 3. Such a conversion to water injection should be made at the maximum net recovery of oil which can be obtained. Water conversion at this time further increases the maximum net recovery possible at a minimum cost.

The timing of the conversion from high quality steam to low quality steam is also very important. Conversion should occur at approximately the time of steam breakthrough. A conversion from high quality steam too soon before steam breakthrough substantially lowers the efficiency of the flood, resulting in a smaller recovery. This is emphasized in FIG. 1 by the curve drawn for a six month earlier conversion time using the invention method of constant heat injection. Net oil recovery for the early conversion time was only 25% of the net oil recovery for the invention method examples where conversion occurred after the injection of 0.48 pore volumes of high quality steam. The ultimate and net oil recoveries for the six month earlier conversion time fall outside of the range of the FIGS. 2 and 3 window plots. The six month later conversion timing yielded recoveries similar but slightly lower to that of the invention method due to the extra heat lost through production wells after steam breakthrough.

Figure 4:
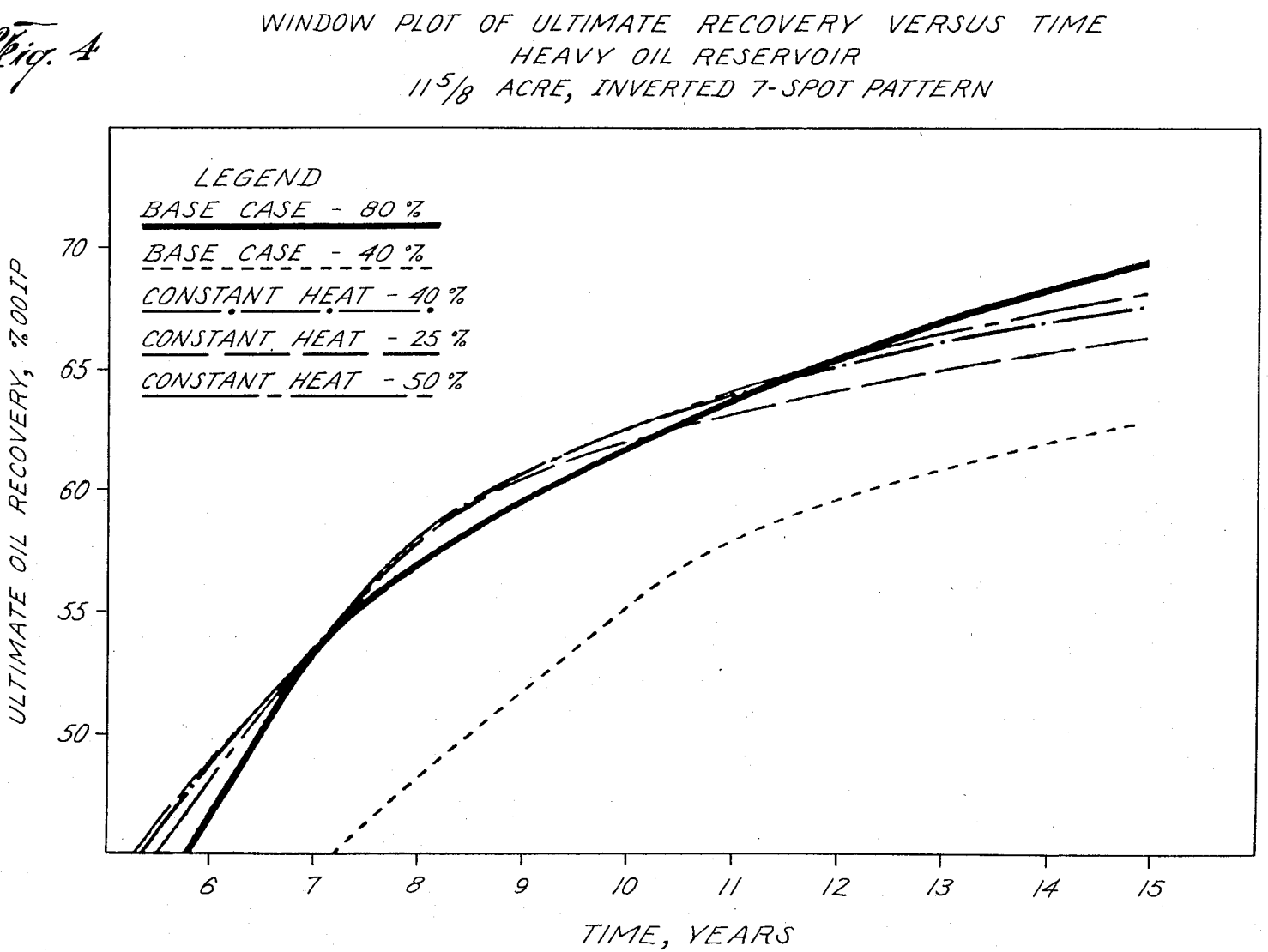
FIG. 4 is a graph illustrating the ultimate recovery of several constant heat injection methods.
Figure 5:
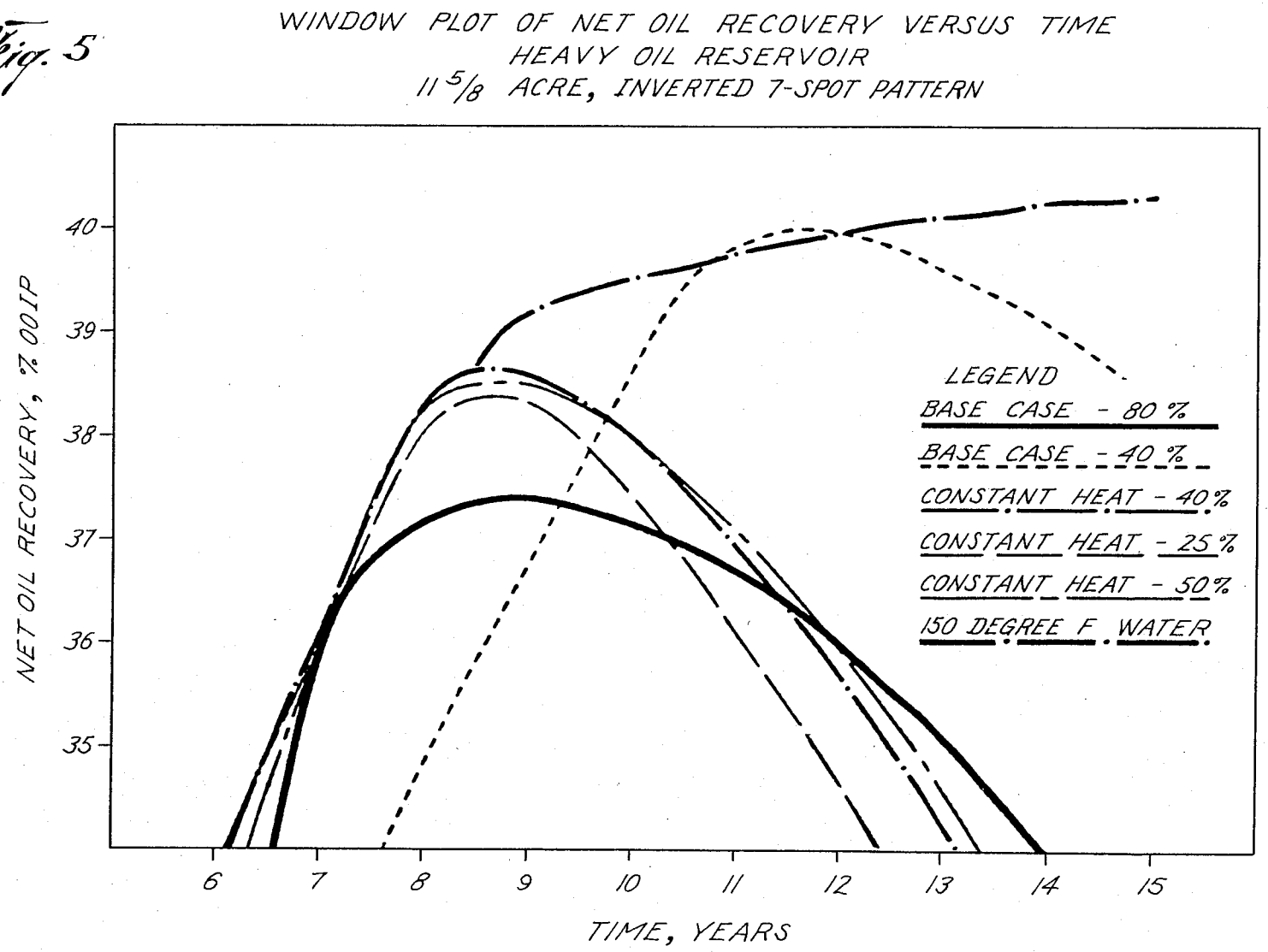
FIG. 5 is a graph illustrating the net oil recovery of several constant heat injection methods.

FIGS. 4 and 5 illustrate the ultimate and net oil recovery possible with several different cases of reduced quality steam injection at constant heat injection rates. The method of the invention was simulated with the conversion to 25%, 40% and 50% quality steam at a constant heat injection rate. It should be emphasized that the greatest net oil recovery occurred with the constant heat injection of the 40% quality steam. However, the differences between the net oil recovery with the 25%, 40% and 50% steam quality, constant heat injection cases was statistically insignificant, directly contradicting the substantial advantages alleged for 40% quality steam over 20%, 50% and 60% quality steam in U.S. Pat. Nos. 4,060,129 and 4,093,027, previously cited. These results indicate a relative insensitivity to either the quality of steam utilized at the time of conversion as long as it was within the 25% to about 50% range, or the average steam quality achieved in the reservoir at some later point in time as long as the heat injection rate is maintained at a constant level.

Figure 6:
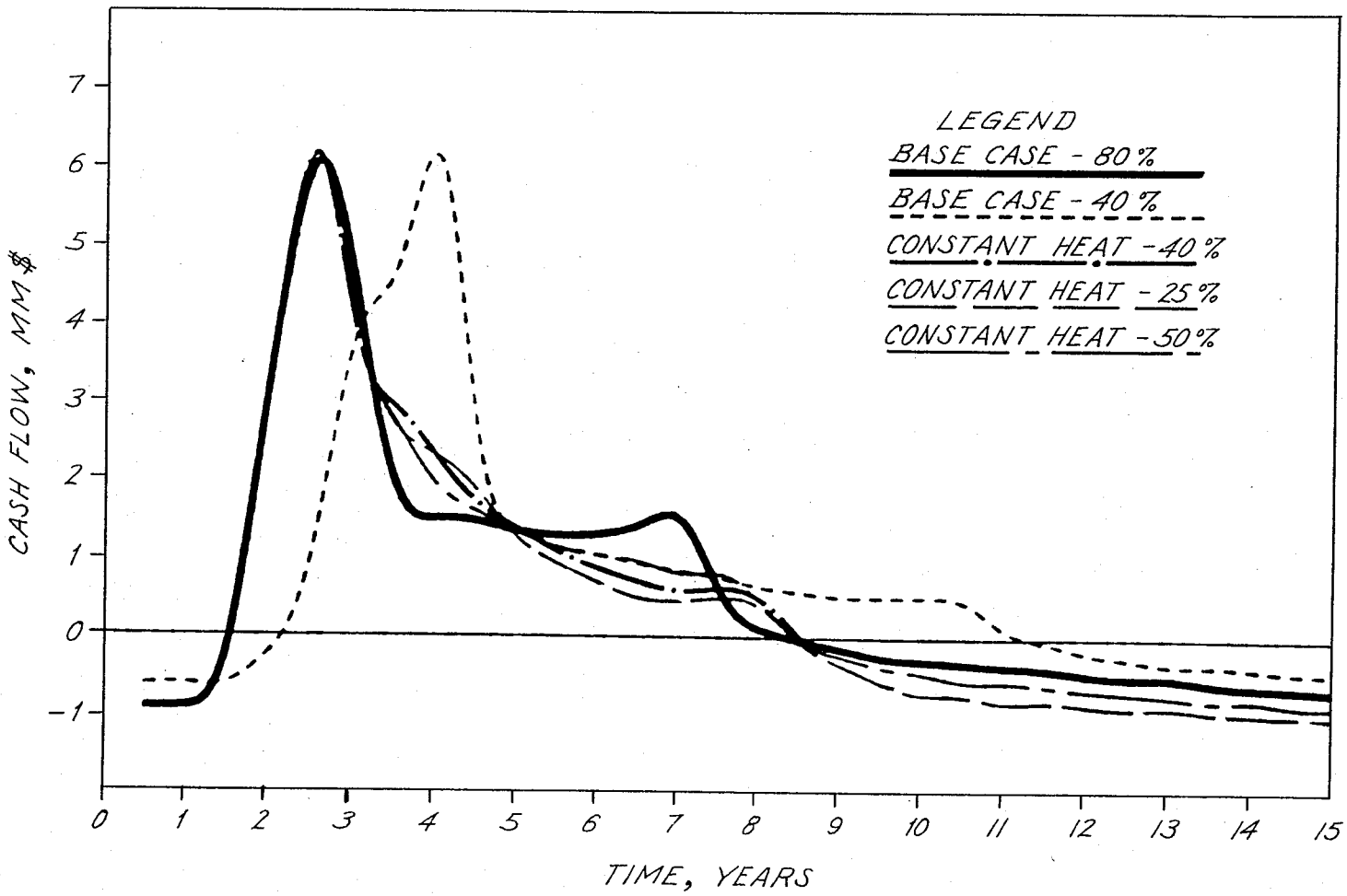
FIG. 6 is a comparison of the pattern cash flow for two prior art injection methods and several constant heat injection methods.

Further, Examples 4 and 5 demonstrate that the constant injection of 40% quality steam can result in a slightly higher maximum net recovery (See Base Case-40%). But as shown in FIG. 6, which illustrates monthly cash flow, the resulting economics are not as attractive due to the longer injection time required. Specifically, the 40% constant quality steam injection case requires $1\frac{1}{2}$ to 2 years longer to produce the same level of cash flow as the constant heat injection method of the present invention. FIG. 6 demonstrates the substantial economic advantages of earlier oil recovery to be achieved with the constant heat injection and steam quality conversion method of the present invention.

The economics of an enhanced oil recovery project tend to be more favorable to those recovery processes or techniques that will lead to realization of the maximum net recovery potential in the shortest time frame. Because of this earlier recovery, the present invention offers substantial advantages over the prior art.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method for recovering hydrocarbons from an underground hydrocarbon formation penetrated by at least one injection well and at least one production well, which comprises:

(a) injecting steam of a relatively high quality into the formation through an injection well;

(b) reducing the quality of the steam being injected to a quality of about 25% to about 50% at about the time of steam breakthrough at a production well;

(c) increasing the rate of steam injection simultaneously with reducing the quality of the steam to maintain a constant input of heat into the formation; and (d) recovering hydrocarbons and other fluids at a production well.

2. The method of claim 1 for recovering hydrocarbons, wherein the steam of a relatively high quality has a quality of about 70% to about 100%.

3. The method of claim 1 for recovering hydrocarbons, wherein about 0.2 pore volumes to about 1.0 volumes of steam of a relatively high quality is injected into one or more injection

4. The method of claim 1 for recovering hydrocarbons, wherein about 0.5 pore volumes to about 2.5 pore volumes of steam having a quality of about 25% to about 50% is injected into one or more injection wells.

5. The method of claim 4 for recovering hydrocarbons, further comprising the injecting of water into one or more injection wells after the injection of about 25% to about 50% quality steam.

6. The method of claim 5 for recovering hydrocarbons, wherein the water being injected has a temperature of about 120° F. to about 180° F.

7. The method of claim 1 for recovering hydrocarbons, wherein the quality of steam is gradually reduced in an essentially linear manner from a relatively high quality steam.

8. A method for recovering hydrocarbons from an underground formation penetrated by at least one injection well and at least one production well, which comprises:

(a) injecting about 0.2 pore volumes to about 1.0 pore volumes of steam having a quality of about 70% to about 100% into the formation through an injection well;

(b) reducing the quality of the steam being injected to a quality of about 25% to about 50% at about the time of steam breakthrough at a production well;

(c) increasing the rate of steam injection simultaneously with reducing the quality of the steam to maintain a constant input of heat into the formation, (d) said reduced quality steam injected in the amount of about 0.5 pore volumes to about 2.5 pore volumes;

(e) discontinuing steam injection;

(f) injecting water having a temperature of about 120° F. to about 180° F. into an injection well; and (g) recovering hydrocarbons and other fluids at a production well.

* * * * *